US008708378B2

(12) United States Patent
Frazier

(10) Patent No.: US 8,708,378 B2
(45) Date of Patent: Apr. 29, 2014

(54) GATE LATCH

(76) Inventor: James Frazier, Southington, OH (US)

( * ) Notice: Subject to any disclaimer, the term of this patent is extended or adjusted under 35 U.S.C. 154(b) by 226 days.

(21) Appl. No.: 13/157,475

(22) Filed: Jun. 10, 2011

(65) Prior Publication Data

US 2012/0274080 A1 Nov. 1, 2012

Related U.S. Application Data

(60) Provisional application No. 61/479,560, filed on Apr. 27, 2011.

(51) Int. Cl.

| | |
|---|---|
| ***E05C 1/02*** | (2006.01) |
| ***E05B 65/00*** | (2006.01) |
| ***E05B 65/08*** | (2006.01) |
| *E05C 5/02* | (2006.01) |

(52) U.S. Cl.

CPC ..... *E05B 65/0007* (2013.01); *E05B 65/0864* (2013.01); *E05C 5/02* (2013.01); *Y10S 292/29* (2013.01)

USPC ..... 292/137; 292/57; 292/63; 292/183; 292/281; 292/DIG. 29

(58) Field of Classification Search

USPC ..... 292/1, 57, 58, 63, 64, 67, 137, 183, 292/184, 189, 281, 283, DIG. 17, DIG. 29; 256/1, 73

See application file for complete search history.

(56) References Cited

U.S. PATENT DOCUMENTS

| | | | | |
|---|---|---|---|---|
| 874,712 | A * | 12/1907 | Tyden | 292/57 |
| 988,455 | A * | 4/1911 | Gee | 292/189 |
| 1,073,063 | A | 9/1913 | Altman | |
| 1,136,102 | A | 4/1915 | Clapcott | |
| 1,341,569 | A * | 5/1920 | Magee | 292/189 |
| 1,429,389 | A | 9/1922 | Weintz | |
| 1,449,587 | A | 3/1923 | Colvin | |
| 1,487,667 | A * | 3/1924 | Omler | 292/114 |
| 1,548,907 | A | 8/1925 | Schweim | |
| 1,749,001 | A | 3/1930 | Scheeler | |
| 1,944,382 | A | 1/1934 | Wecker | |

(Continued)

FOREIGN PATENT DOCUMENTS

JP 06-323044 11/1994

OTHER PUBLICATIONS

Office Action from co-pending U.S. Appl. No. 13/456,646 dated Aug. 7, 2013.

*Primary Examiner* — Carlos Lugo

(74) *Attorney, Agent, or Firm* — Cermak Nakajima LLP; Adam J. Cermak

(57) ABSTRACT

A gate latch includes a bracket including a vertical backplate, a lower plate, and an upper plate. Each of the plates is attached to and extends in the same direction away from the backplate. Each of the plates includes first and second throughholes, in which the first throughhole of the lower plate is vertically aligned with the first throughhole of upper plate, and the second throughhole of lower plate is vertically aligned with the second throughhole of the upper plate. The latch includes a rigid bolt including first, second, and third elongate portions, with the first and third elongate portions being connected together, the second and third elongate portions being connected together, and the first and second elongate portions being parallel. The first elongate portion is movably positioned in the first throughholes of the upper and lower plates, and the second elongate portion is movably positioned in the second throughholes of the upper and lower plates.

10 Claims, 10 Drawing Sheets

(56) References Cited

U.S. PATENT DOCUMENTS

| | | | | | |
|---|---|---|---|---|---|
| 2,074,759 | A | * | 3/1937 | Richards | 292/68 |
| 2,668,729 | A | | 2/1954 | Watters | |
| 2,735,715 | A | | 2/1956 | Reifsteck | |
| 2,759,752 | A | | 8/1956 | Demings | |
| 3,844,520 | A | | 10/1974 | Werner et al. | |
| 3,888,527 | A | * | 6/1975 | Haisler | 292/213 |
| 3,918,753 | A | * | 11/1975 | McCormack et al. | 292/216 |
| 3,926,018 | A | | 12/1975 | Joersz | |
| 4,111,475 | A | | 9/1978 | McCormick et al. | |
| 4,135,747 | A | | 1/1979 | Melilli | |
| 4,286,810 | A | * | 9/1981 | Ehmen | 292/67 |
| 4,305,178 | A | | 12/1981 | Caplette | |
| 4,355,829 | A | | 10/1982 | Gregory | |
| 4,553,739 | A | | 11/1985 | Baines | |
| 4,799,720 | A | | 1/1989 | Watson et al. | |
| 5,141,119 | A | | 8/1992 | Milazzo | |
| 5,226,684 | A | * | 7/1993 | De La Garza | 292/213 |
| 5,427,422 | A | | 6/1995 | Madlener et al. | |
| 6,092,402 | A | | 7/2000 | Procelli et al. | |
| 6,412,314 | B1 | | 7/2002 | Jenks | |
| 6,698,256 | B2 | | 3/2004 | Witchey | |
| 7,021,678 | B1 | | 4/2006 | Raoult | |
| 7,503,194 | B2 | | 3/2009 | McNeil | |

* cited by examiner

GATE LATCH

This application claims priority under 35 U.S.C. §119 to U.S. Provisional Application No. 61/479,560, filed 27 Apr. 2011, the entirety of which is incorporated by reference herein.

BACKGROUND

1. Field of Endeavor

The present invention relates to devices, systems, and processes useful as gate latches.

2. Brief Description of the Related Art

While caring for beef cattle, one must open and close gates many times each day. Chains are used to secure the gates. Some chains extend from the gate, around a post and back to the gate, while others go from the gate to an eyebolt on the post. Some of the chains have a spring closed hook on the end, while others fit into a slotted plate to keep them in place. The chains are durable, inexpensive, and provide good security.

A disadvantage of using chains is that sometimes both hands are required to open the gate, and usually both hands are required to secure the gate closed. This makes it necessary to put down and pick up a bucket or bale that is being carried through the gate. Another problem is that the chains and hooks are difficult to manipulate when wearing heavy winter gloves. This extra effort and time would not be necessary if the right kind of gate latch was available.

A search of gate latches available on the market showed that most were not strong enough for large animal gates. The gate latches that were most suitable for these needs were quite expensive and still had some disadvantages.

It became an object to develop a better gate latch; ideal for farm gates confining large animals. The design goals were:

Strong enough to withstand the force of a 2,000 pound animal leaning on the gate.

Able to maintain a strong connection between the gate and the post if the gate was bent or the post pulled away from the gate.

No pointed of narrow edges extending out from the gate or post that could injure an animal or worker.

A latch opening mechanism that could be easily opened with one hand covered by a heavy winter glove, but not likely to be opened by animal activity.

A latch opening mechanism positioned so that the hand opening the latch was already in a position to control the movement of the gate.

Easy to manufacture; to make the final cost lower than the current heavy duty gate latches on the market.

Easy to install on round or flat wood posts, metal tube posts, metal tube gates, and flat wood gates.

Applicable to different gate installations (gates closing against the post, left or right, and gates swinging past the post to open in and out).

Self-latching when the gate closed.

SUMMARY

According to a first aspect of the invention, a gate latch comprises a bracket including a vertical backplate, a lower plate, and an upper plate, each of the plates attached to and extending in the same direction away from the backplate, each of the plates including first and second throughholes, wherein the first throughhole of the lower plate is vertically aligned with the first throughhole of the upper plate, and the second throughhole of lower plate is vertically aligned with the second throughhole of the upper plate, and a rigid bolt including first, second, and third elongate portions, the first and third elongate portions being connected together, the second and third elongate portions being connected together, and the first and second elongate portions being parallel, wherein the first elongate portion is movably positioned in the first throughholes of the upper and lower plates, and the second elongate portion is movably positioned in the second throughholes of the upper and lower plates.

Still other aspects, features, and attendant advantages of the present invention will become apparent to those skilled in the art from a reading of the following detailed description of embodiments constructed in accordance therewith, taken in conjunction with the accompanying drawings.

BRIEF DESCRIPTION OF THE DRAWINGS

The invention of the present application will now be described in more detail with reference to exemplary embodiments of the apparatus and method, given only by way of example, and with reference to the accompanying drawings, in which.

DETAILED DESCRIPTION OF EXEMPLARY EMBODIMENTS

Figure 2:
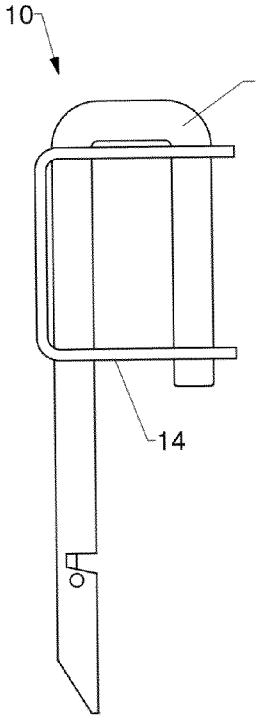
FIG. 2 illustrates a front elevational view of the gate latch of FIG. 1 in a latched orientation.

Referring to the drawing figures, like reference numerals designate identical or corresponding elements throughout the several figures.

Figure 3:
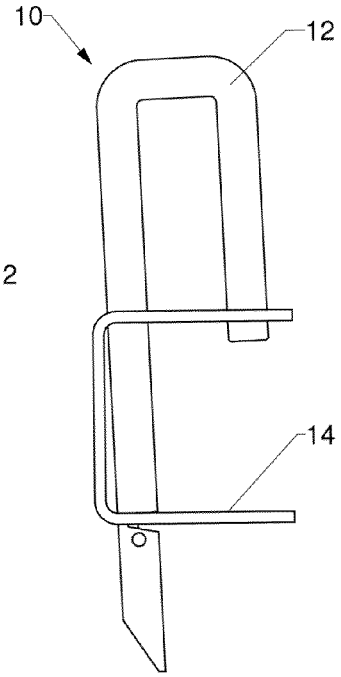
FIG. 3 illustrates a front elevational view of the gate latch of FIG. 1 in an unlatched orientation.
Figure 4:
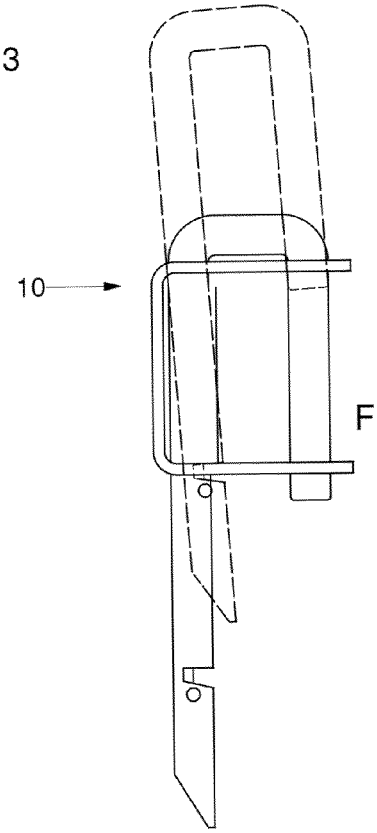
FIG. 4 illustrates a front elevational view of the gate latch of FIG. 1 moving between the orientations of FIGS. 2 and 3.
Figure 5:
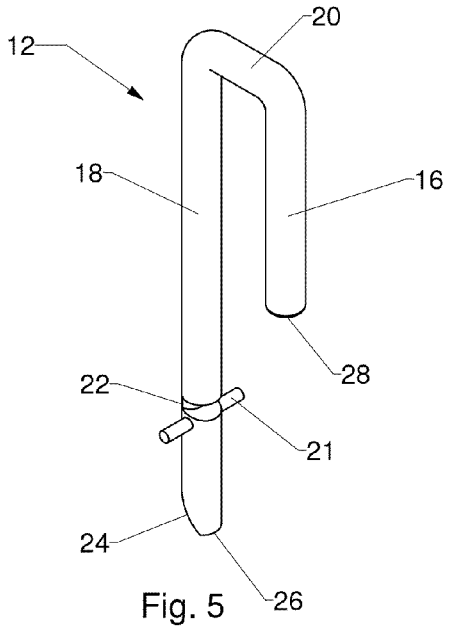
FIG. 5 illustrates a perspective view of the bolt of the embodiment of FIG. 1.
Figure 6:
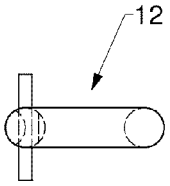
FIG. 6 illustrates a top plan view of the bolt of FIG. 5.
Figure 7:
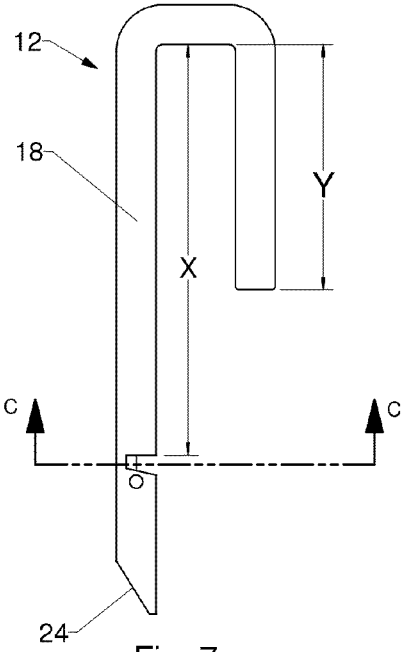
FIG. 7 illustrates a front elevational view of the bolt of FIG. 5.
Figure 8:
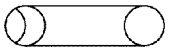
FIG. 8 illustrates a cross-sectional view the bolt of FIG. 5, taken at line C-C in FIG. 7.
Figure 9:
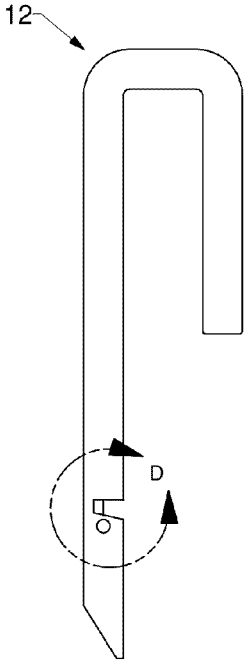
FIG. 9 illustrates a front elevational view of the bolt of FIG. 5.
Figure 10:
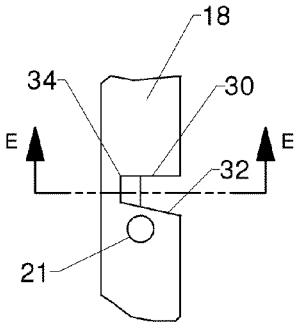
FIG. 10 illustrates a portion of the bolt of FIG. 9, taken at detail D.
Figure 11:
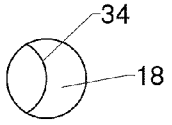
FIG. 11 illustrates a cross-sectional view the bolt of FIG. 5, taken at line E-E in FIG. 10.
Figure 12:
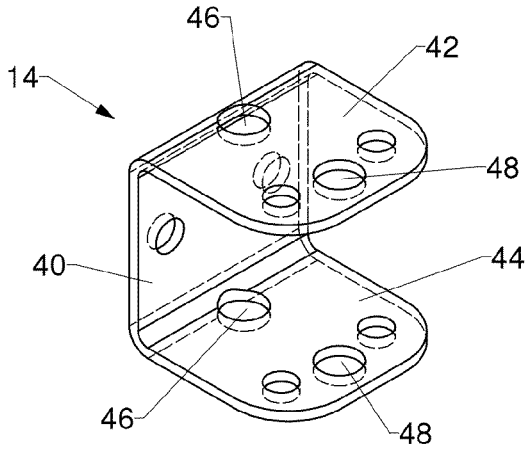
FIG. 12 illustrates a perspective view of the bracket of the embodiment of FIG. 1.

FIGS. 1-4 illustrate several views of a first exemplary embodiment of a gate latch 10. The latch 10 includes a generally U-shaped, movable bolt 12 and a generally U-shaped bracket 14. FIG. 2 illustrates the bolt 12 positioned in a locked, closed, or latched orientation in the latch, with two portions of the bolt extending completely across the bracket 14; FIG. 3 illustrates the bolt 12 positioned in an unlocked, open, or unlatched orientation in the latch, with only one portion of the bolt extending completely across the bracket; and FIG. 4 illustrates the two orientations, with the open orientation in dotted line.

FIGS. 5-11 illustrate the bolt 12 of FIG. 1 in numerous views, which will be described together. The bolt 12 includes a first elongated portion 16, a second elongate portion 18 which is longer than and parallel to the first portion 16, and a third portion 20 which joins together two ends of the first and second portions. While the embodiment illustrated in FIG. 1 includes a bolt 12 having a circular cross-section, other cross-sectional shapes can be used. The second portion 18 includes a retaining pin 21 which is mounted through, welded on, or otherwise positioned on the second portion and extends generally perpendicular to the second portion. The retaining pin, which could also be a cotter pin or the like positioned in a transverse throughbore, is provided to inhibit, and preferably prevent, the bolt 12 from being pulled up and completely out of the bracket 14. The second portion 18 of the bolt 12 also includes a recess 22 formed just above the pin 20. The recess 22 provides a surface 30 (FIG. 10) on which the bolt can engage the bracket 14 and be temporarily hung in place in an open orientation (see, e.g., FIGS. 3, 4, 20, and 30). The recess 22 is defined by a top surface 30, an inclined bottom surface 32, and a rear surface 34 (FIG. 10) which can be curved (FIG. 11) or some other shape.

The second portion 18 includes a free end 26, which includes an angled portion 24, and first portion 16 includes a free end 28. The angled portion 24 creates a narrow surface on the free end of portion 18, away from the gate post, that is easily engaged by the edge of a gloved hand when lifting the bolt and moving the surface 30 onto plate 14.

Figure 13:
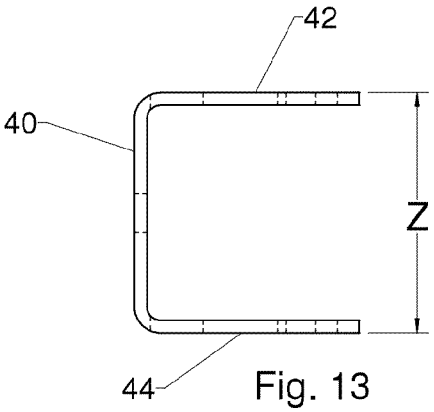
FIG. 13 illustrates a front elevational view of the bracket of FIG. 12.
Figure 14:
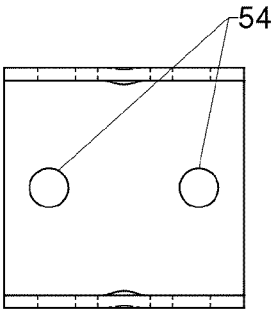
FIG. 14 illustrates a right side elevational view of the bracket of FIG. 12.
Figure 15:
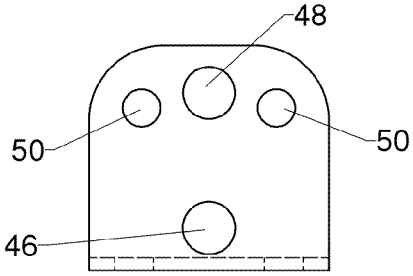
FIG. 15 illustrates a top plan view of the bracket of FIG. 12.
Figure 16:
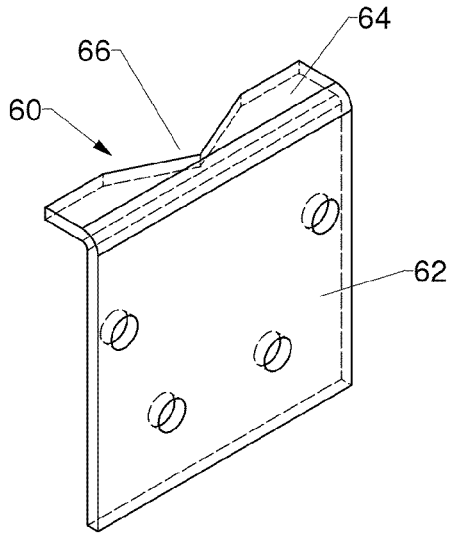
FIG. 16 illustrates a perspective view of a first exemplary embodiment of a post adapter plate.
Figure 17:
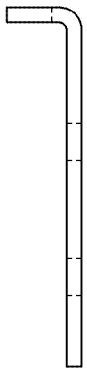
FIG. 17 illustrates a front elevational view of the plate of FIG. 16.
Figure 18:
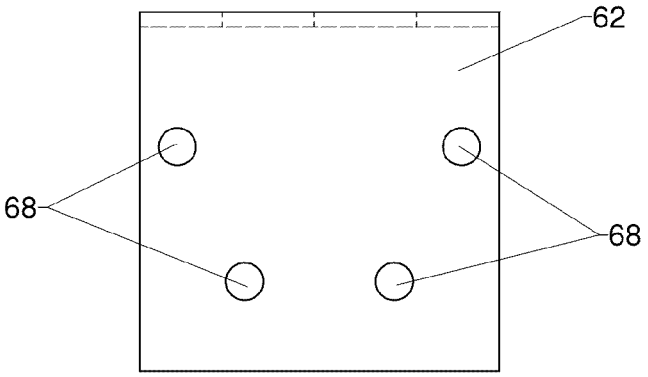
FIG. 18 illustrates a right side elevational view of the plate of FIG. 16.
Figure 19:
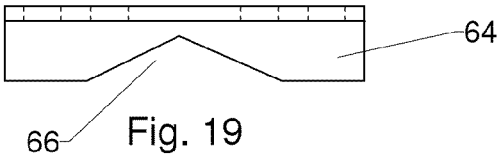
FIG. 19 illustrates a top plan view of the plate of FIG. 16.

The distances X, Y, and Z (FIG. 13) are mutually selected so that, as illustrated in FIGS. 3, 4, 20, and 30: the first portion 16 of the bolt 12 can extend fully between the two plates of the bracket 14, and thus capture a portion of another element of the latch (e.g., an eye-bolt) which is positioned inside the bracket; and the first portion 16 of the bolt 12 can be lifted so that it does not extend fully between the two plates of the bracket 14, and thus releases the portion of the other element of the latch positioned inside the bracket. The length of the third portion 20, and thus the distance between the first 16 and second 18 portions, is selected so that the captured element will easily fit between the first and second portions.

FIGS. 12-15 illustrate the bracket 14 of FIG. 1 in numerous views, which will be described together. The bracket 14 includes a backplate 40, an upper plate 42, and a lower plate 44 which is advantageously parallel to the upper plate. The upper plate 42 and the lower plate 44 are both attached to the backplate 40, and thus cause the bracket 14 to define U-shape. The backplate includes at least one, and advantageously a plurality of throughholes 54, which can be used to mount the bracket to posts and other structures, using additional elements described in greater detail herein. The upper plate 42 and the lower plate 44 also include throughholes 46, 48, in which portions of the bolt 12 are received. More specifically, the holes 46 are vertically in alignment, permitting the second portion 18 of the bolt 12 to extend through both holes 46; and the holes 48 are vertically in alignment, permitting the first portion 16 of the bolt 12 to extend through both holes 48. The plates 42, 44 also preferably, although not necessarily, include one or more locking holes 50 through which a pad lock or the like can pass, to more permanently secure the gate latch 10, as described in greater detailed elsewhere herein.

FIGS. 16-19 illustrate several views of an exemplary post adapter plate 60 which can optionally be used with the gate latch 10. The adapter plate 60 includes a flat backplate 62 and a flange 64 that extends, preferably perpendicularly, from one end of the backplate. The flange 64 includes a cutout 66 which is provided so that a portion of a post, which can be cylindrical, can be received in the cutout and secured therein. While the cutout 66 is advantageously V-shaped, so that cylindrical posts of varying radii can be accommodated with a single adapter plate 60, other shapes can be used. The backplate 62 is also optionally provided with a plurality of throughholes 68, so that the adapter plate 60 can be bolted to the gate latch 10, and more particularly to the bracket 14 via its throughholes 54. Other embodiments unite the adapter plate 60 and the bracket 14, such as by welding the two pieces together for permanent fixture, or by providing the flange 64 on the exterior of the bracket 14.

Figure 1:
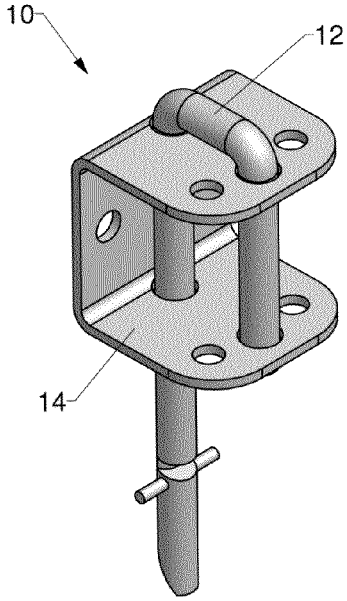
FIG. 1 illustrates a perspective view of a first exemplary embodiment of a gate latch.
Figure 20:
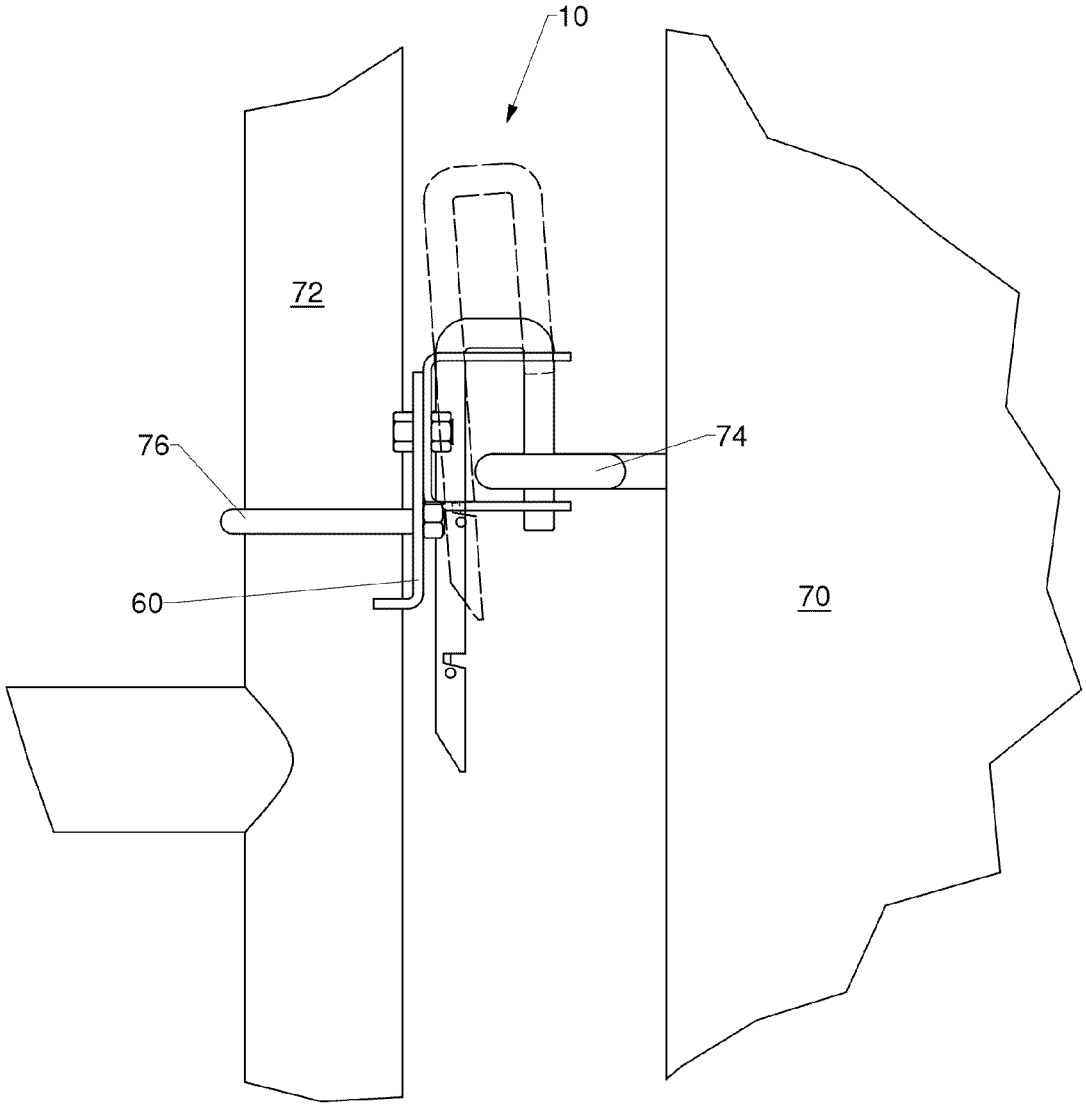
FIG. 20 illustrates a front plan view, with portions broken away, of the embodiment of FIG. 1 implemented between a post and a gate.
Figure 21:
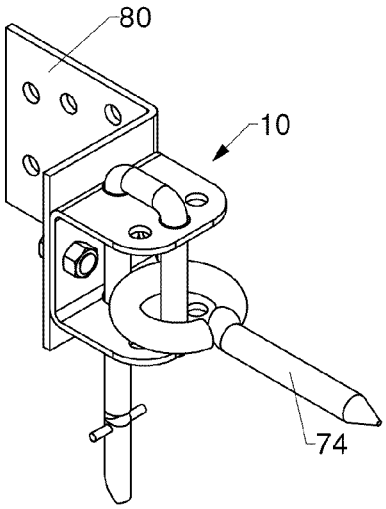
FIG. 21 illustrates a perspective view of the embodiment of FIG. 1 in a configuration useful for use with a wood gate, a sliding door, or a hinged door.
Figure 22:
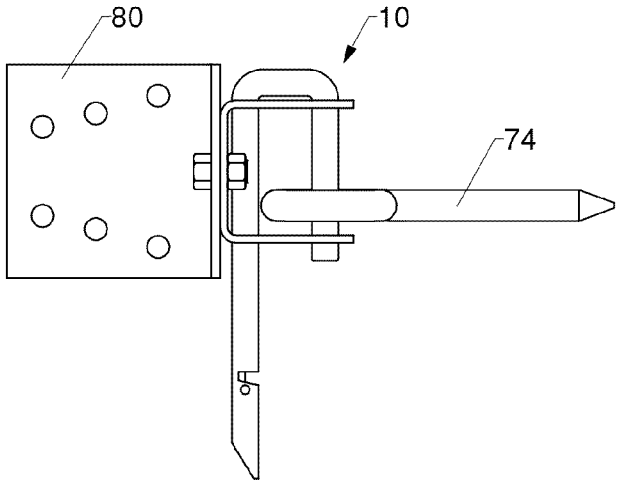
FIG. 22 illustrates a front elevational view of the configuration of FIG. 21.
Figure 23:
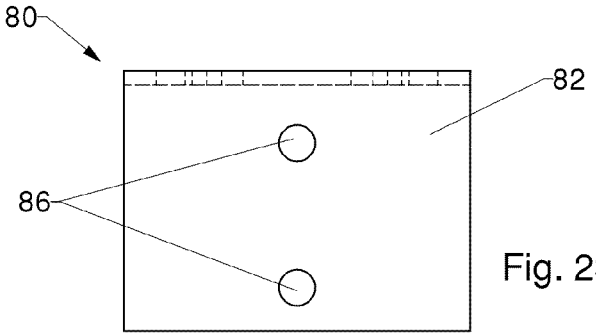
FIG. 23 illustrates a top plan view of a plate of FIG. 21.
Figure 24:
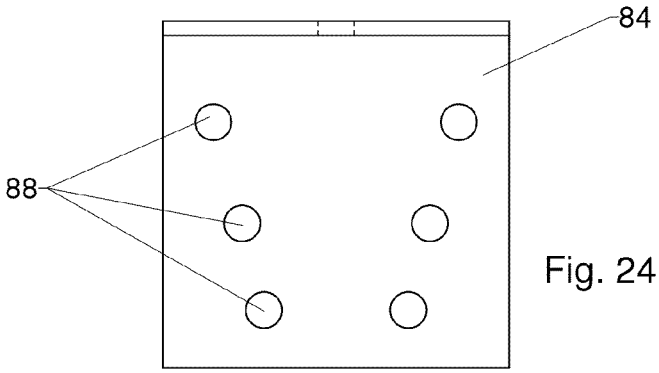
FIG. 24 illustrates a front elevational view of the plate of FIG. 23.

FIG. 20 illustrates a front plan view, with portions broken away, of the embodiment of FIG. 1 implemented between a fixed wooden post 70 and the post 72 of a swing gate. The adapter plate 60 has been bolted to the bracket 14, as discussed above. A U-bolt 76 of conventional construction is positioned around the post 72, with the threaded ends of the U-bolt attached to the adapter plate 60 via a pair of its holes 68. An eye lag 74 of conventional construction is mounted to the vertical face of the post 70, e.g., by screwing the threaded end of the eye lag into the wood of the post (eye bolts with machine threads, pushed entirely through a throughbore in the post and secured with nuts, can also be used), with the eye of the eye lag positioned so that, when the post 72 is positioned adjacent to the post 70, the eye is located between the plates 42, 44 of the bracket 14.

To operate the gate latch 10 in the configuration of FIG. 20, the bolt 12 is moved to the upper, open orientation, illustrated in broken lines in FIG. 20. When the gate of post 72 is swung so that the posts 70, 72 are adjacent to each other and the eye of the eye lag 74 is located between the plates 42, 44 of the bracket 14, the first portion 16 of the bolt 12 is positioned above the eye of the eye lag, temporarily suspended there by the surface 30 being hung on the lip of hole 46 in the lower plate 44 through which the second portion 18 of the bolt 12 extends. Because of the pin 21, the first portion 16 of the bolt 12 cannot be pulled out of the hole 48 in the upper plate 42. When it is desired to lock the gate, the bolt 12 is merely manipulated so that the second portion 18 falls down further into the hole 46 in the lower plate 44, which simultaneously causes the first portion 16 of the bolt 12 to pass through the eye of the eye lag 74 and, because portions 16, 18 are parallel and the holes 46, 48 are vertically aligned, directly into hole 48 in lower plate 44. The post 72 is thus restrained from swinging away from the post 70, because the first portion 16 of the bolt 12 has captured the eye of the eye lag 74 between the upper and lower plates 42, 44. Lifting the bolt 12 releases the eye lag 74 and unlatches the gate latch 10. With brief reference to FIGS. 1 and 12, once in the latched orientation, the gate latch 10 can be more permanently locked by passing a locking device, e.g., a padlock, through a pair of the vertically aligned holes 50 in the bracket 14 and through the eye of the eye lag 74

FIGS. 21-24 illustrate several views of another configuration of a gate latch embodying principles of the present invention, one which can be advantageously used with a wood gate, sliding door, or a hinged door. In addition to the structures already described, an angle bracket 80, having plates 82, 84 joined at a right angle and holes 86, 88 therein, is attached to the bracket 14 via bolts. The plate 84 is attached to the vertical inside surface of a door, one which does not fit within a door jam, and the eye lag 74 is mounted to the jam. When the door is swung closed, the bolt 12 can retain the eye lag 74 as previously described. A string, cable, wire, or the like (not illustrated), attached to the third portion 20 of the bolt 12, and lead up and away from the gate latch 10, can pass over the door, or through a hole or the like in the door above the gate latch, and to the outside of the door; pulling on the string pulls up on the bolt 12, thus releasing the eye lag 74 and unlatching the gate latch 10, while the weight of the bolt 12 is sufficient to close the gate latch 10 when the string is released. Alternatively, for mounting to the exterior of a similar door (one which does not fit within a door jamb), the plate 84 of the angle bracket 80 can be mounted to the exterior of the door, with the plate 82 extending inward, towards the jam. An eye lag 74 is mounted to the exterior surface of the jam, with the eye extending straight out. The bolt 12 and its interaction with the eye lag 74 are thus accessible from the outside of the door. The plate 84 can also be mounted on the interior or exterior of a sliding door where a first sliding door meets a second sliding door, so an eye lag 74 on the second sliding door is captured by the first portion 16 of the bolt, securing the two doors together.

Figure 25:
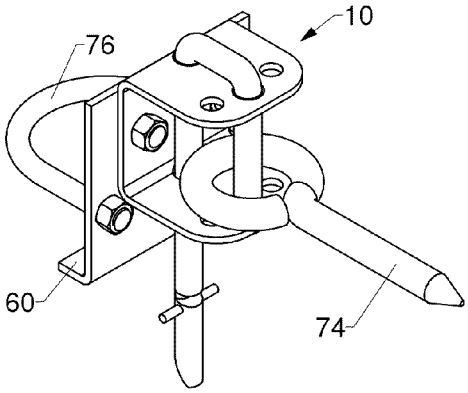
FIG. 25 a perspective view of the configuration of FIG. 20.
Figure 26:
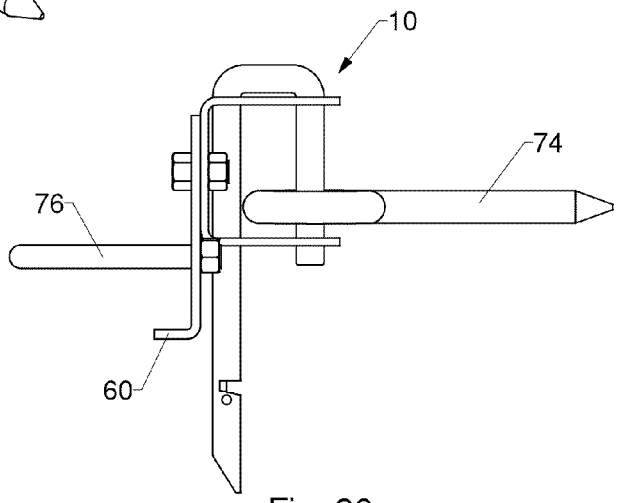
FIG. 26 illustrates a front elevational view of the configuration of FIG. 25.

FIGS. 25 and 26 illustrate views of the configuration of FIG. 20, with the posts 70, 72, not illustrated.

Figure 27:
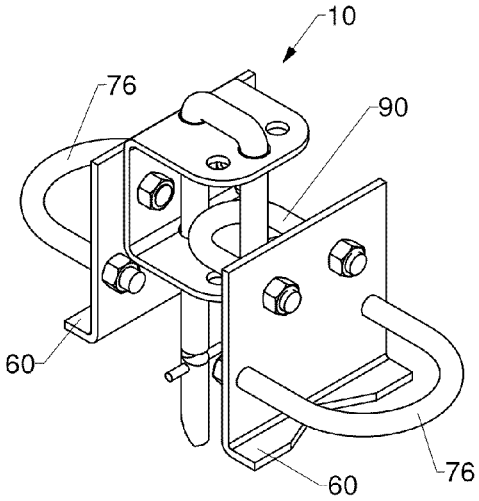
FIG. 27 illustrates a perspective view of the embodiment of FIG. 1 in a configuration useful for between two round posts.
Figure 28:
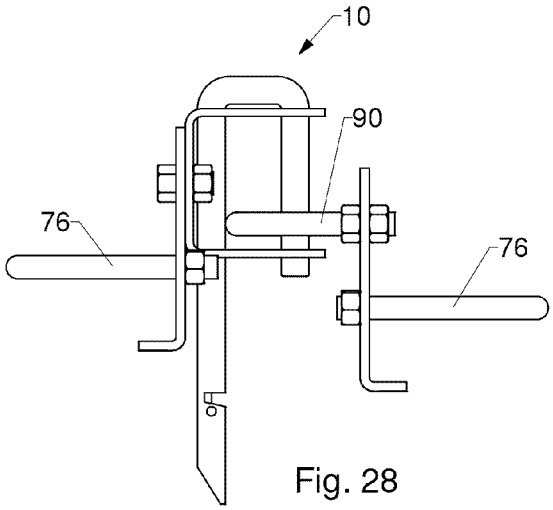
FIG. 28 illustrates a front elevational view of the configuration of FIG. 27.

FIGS. 27 and 28 illustrate two views of the embodiment of FIG. 1 in a configuration useful between two round posts. Instead of an eye lag 74 (FIGS. 25, 26), an adapter plate 60 and second U-bolt 76 secured to the adapter plate are used to present a third U-bolt 90, used instead of the eye of the eye lag, which is also bolted or otherwise attached to the adapter plate.

Figure 29:
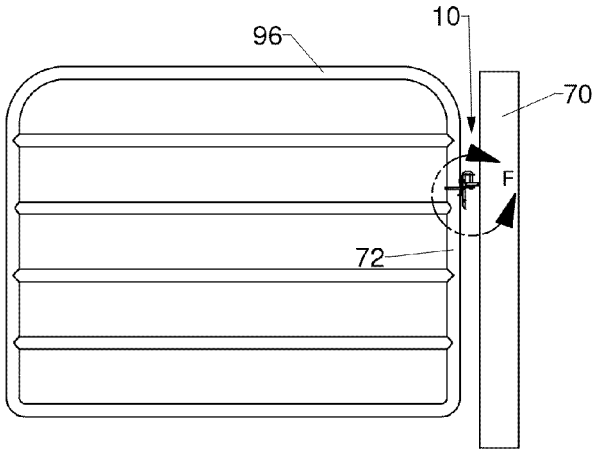
FIG. 29 illustrates a front elevational view of a gate and post latched by the configuration of FIG. 20.
Figure 30:
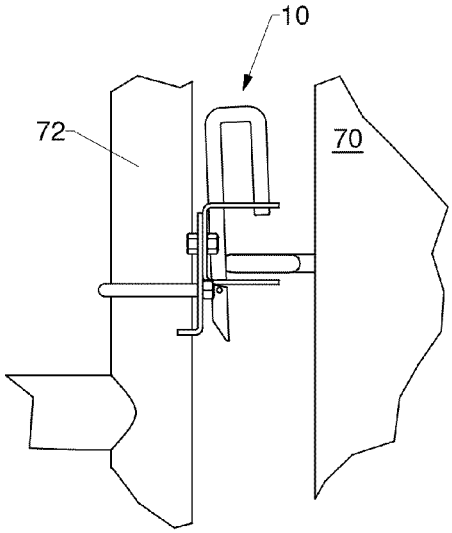
FIG. 30 illustrates an enlarged detail of the configuration of FIG. 29, taken at detail F, in an open or unlatched orientation.
Figure 31:
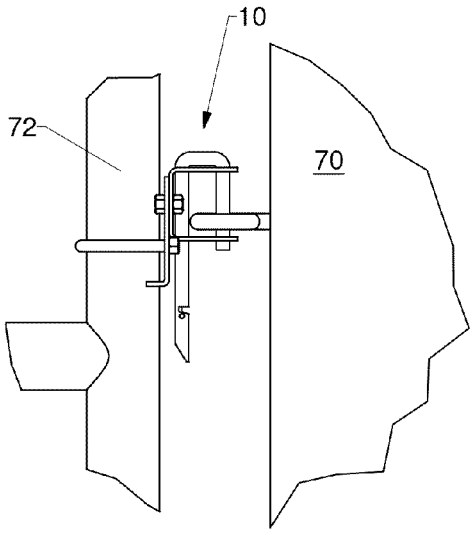
FIG. 31 illustrates an enlarged detail of the configuration of FIG. 29, taken at detail F, in a closed or latched orientation.

FIG. 29 illustrates a front elevational view of a gate 96 and post 70 latched by the configuration of FIG. 20, while FIGS. 30 and 31 illustrate enlarged details at detail F of FIG. 29, in the unlatched and latched orientations of the gate late 10, respectively. The gate 96 is, in a conventional manner, attached to another post or the like (not illustrated) via hinges so that it can swing freely.

FIGS. 32-35 illustrate several views of a second exemplary embodiment of a gate latch 100. The gate latch 100 includes a bolt 102 and a bracket 104 which are similar in some respects to the bolt 12 and the bracket 14 described elsewhere herein. The bolt 102 includes a first portion 106, a second portion 108 parallel to the first portion, and a third portion 110 which joins together the first and second portions. The second portion 108 includes an extension 112 that extends away from the second portion and includes an end tab 114 and a detent 116 positioned between the third portion 110 and the end tab. At least the second portion 108 has a rectangular cross section which inhibits rotation of the bolt in the bracket 104.

The bracket 104 includes a backplate 120, an upper plate 122, and a lower plate 124; the upper and lower plates are attached to and extend perpendicularly away from the backplate to form a general U-shape. The bracket 104 also includes a third plate 126, spaced from the upper plate.

The upper plate 122 and the lower plate 124, as with the plates 42, 44, include holes or slots which slidingly receive portions of the bolt 102. More specifically, the lower plate 124 includes holes 136, 128, and the upper plate 122 includes holes 138, 130, with the holes 136, 138 being vertically aligned and the holes 128, 130 being vertically aligned. The third plate 126 also includes a hole 132 which receives the extension 112.

Figure 34:
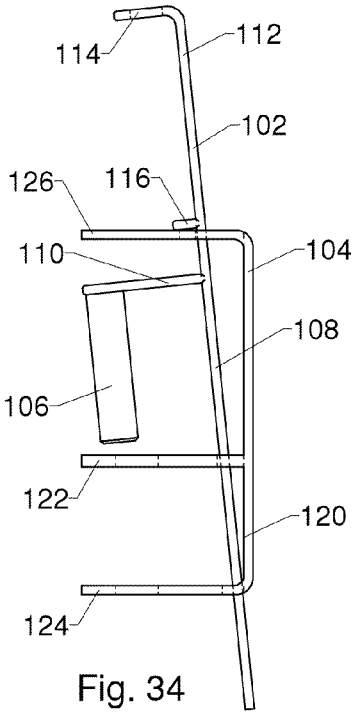
FIG. 34 illustrates a front elevational view of the embodiment of FIG. 32 in an open or unlatched orientation.
Figure 32:
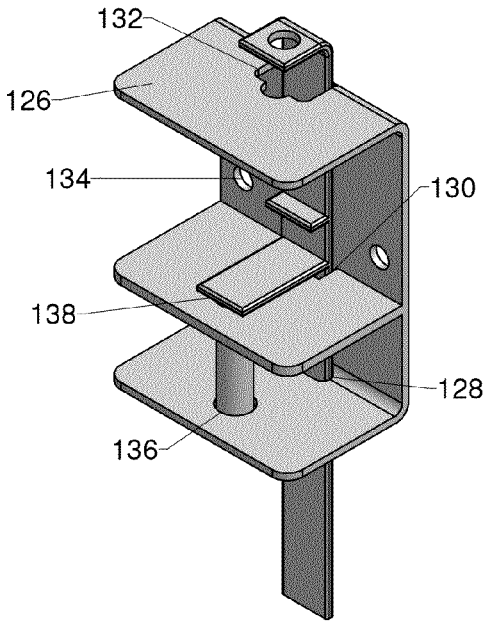
FIG. 32 illustrates a perspective view a second exemplary embodiment of a gate latch.
Figure 33:
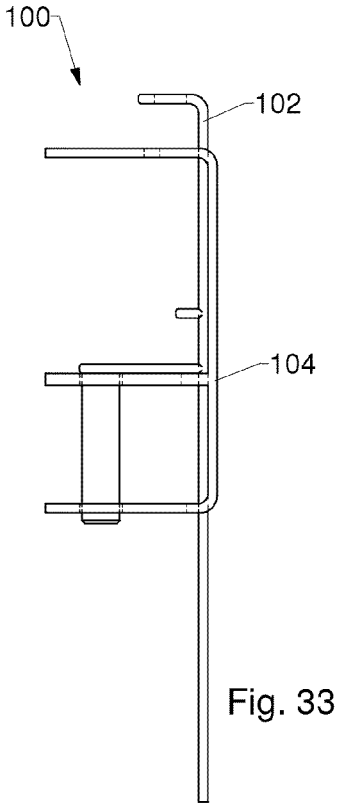
FIG. 33 illustrates a front elevational view of the embodiment of FIG. 32 in a closed or latched orientation.
Figure 35:
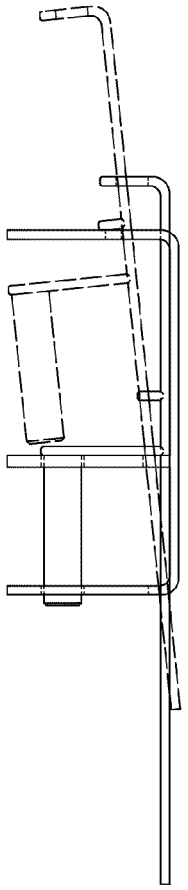
FIG. 35 illustrates a front elevational view of the gate latch of FIG. 32 moving between the orientations of FIGS. 33 and 34.

In operation, the gate latch 100 is first positioned in the open orientation of FIG. 34, with the bolt 102 pulled up relative to the bracket 104. The bolt 102 is canted so that the detent 116 rests on the upper surface of the third plate 126, for which the holes 130, 132 are enlarged. In this open orientation, the first portion 106 has been moved away from the lower plate 124, leaving sufficient space for the eye of an eye lag, eye bolt, U-bolt, or the like to be positioned between the upper and lower plates 122, 124, in a manner similar to other embodiments described herein. While FIGS. 34 and 35 illustrate the first portion 106 not being seated in the hole 138, in other embodiments the length of the first portion is selected so that the first portion is still in the hole 138 when the detent 116 rests on the top surface of the third plate 126. To close the gate latch 100, the extension 112 is tilted back towards the backplate 120, which permits the detent 116 to pass through the hole 132 and the first portion 106 to pass through the holes 136, 138 and retain the eye of eye lag, eye bolt, U-bolt, or the like. Holes 134 are provided in the backplate 104 to serve the same purposes as holes 54.

FIGS. 36-39 illustrate several views of a third exemplary embodiment of a gate latch 200 which is similar in some respects to other embodiments described herein. The gate latch 200 includes a bolt 202 and a bracket 204. The bolt 202 includes a first portion 206, a second portion 208 parallel to the first portion, a third portion 210 which connects together the first and second portions, and a fourth portion 240 connected to the second portion at its end opposite the third portion 210. The fourth portion 240 advantageously extends in the same direction at the third portion 210, but can optionally extend in any direction.

Figure 38:
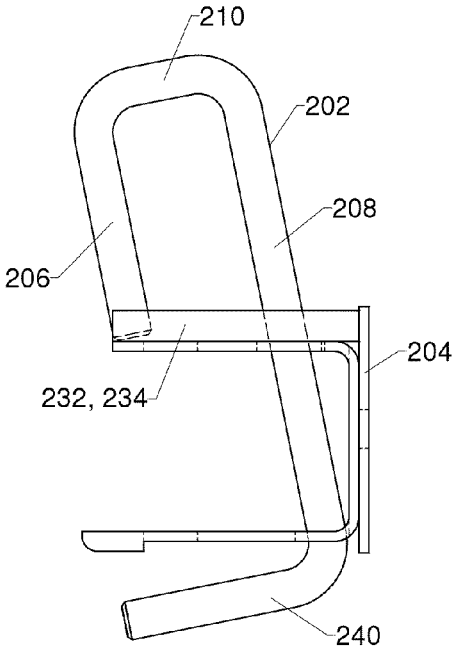
FIG. 38 illustrates a front elevational view of the embodiment of FIG. 36 in an open or unlatched orientation.
Figure 36:
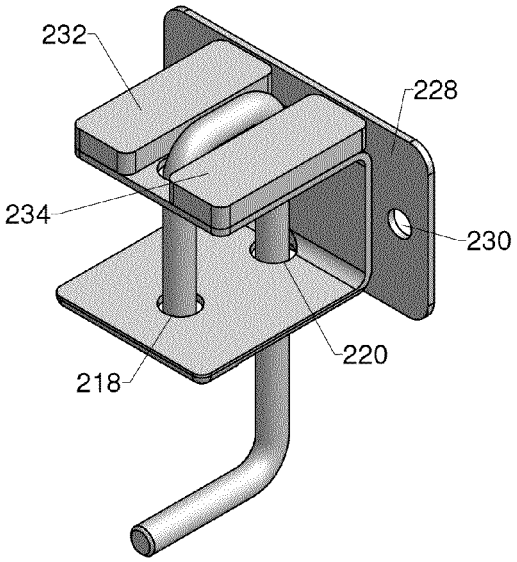
FIG. 36 illustrates a perspective view a third exemplary embodiment of a gate latch.
Figure 37:
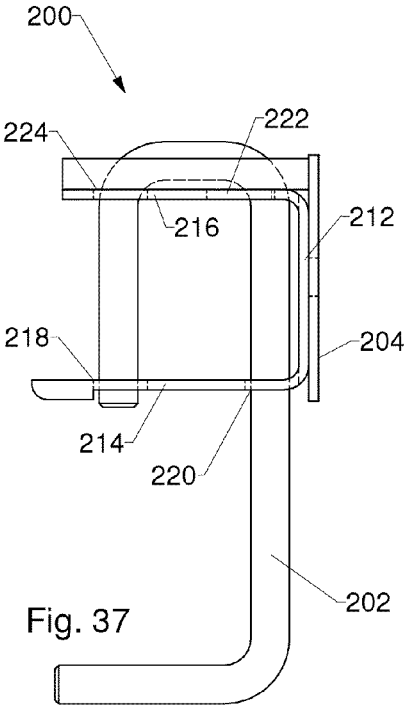
FIG. 37 illustrates a front elevational view of the embodiment of FIG. 36 in a closed or latched orientation.
Figure 39:
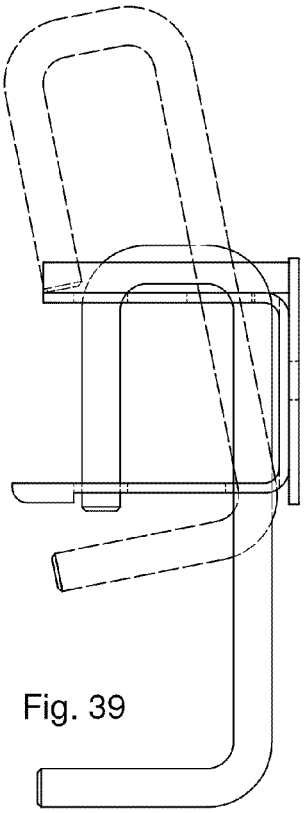
FIG. 39 illustrates a front elevational view of the gate latch of FIG. 36 moving between the orientations of FIGS. 37 and 38.

The bracket 204 includes a vertical backplate 212, a lower plate 214, and an upper plate 216, with the upper and lower plates parallel to each other and extending perpendicularly from the backplate to form a U-shaped space. The lower plate 214 includes holes 218, 220, and the upper plate 216 includes holes 222, 224, with holes 218, 224 being vertically aligned and holes 220, 222 being vertically aligned. Hole 222 is enlarged to permit the second portion 208 to be positioned toward hole 224, as illustrated in FIG. 38, 39. The bracket 204 optionally includes a mounting plate 228, which includes holes 230 similar to holes 54; or, the holes 230 can be formed in the backplate 212 and the mounting plate eliminated. The bracket 204 also includes structures to inhibit or prevent the bolt 202 from being rotated in the holes 220, 222 when in the open orientation (FIG. 38). In accordance with one embodiment, stops 232, 234 are mounted to the top surface of the upper plate 216, positioned at least adjacent to hole 224 and optionally extending toward the backplate 212, and are tall enough so that the free end of the first portion 206 cannot clear the tops of the stops when in the open orientation. When provided with the stops 232, 234, when the bolt 202 is in its uppermost, open orientation, the free end of the first portion 206 is restrained from being rotated away from hole 224, which would otherwise make closing the gate latch 200 more difficult. Additionally or alternatively, at least the portion of the second portion 208 of the bolt 202 can be made of a flat bar stock, and the hole 220 can be formed as a complementary slot, so that the second portion 208 (and thus the entire bolt 202) cannot rotate in the hole 220, in a manner similar to the embodiment of FIGS. 32-35. As with the bolt 102, the second portion 208 can be made shorter so that the free end of the first portion 206 does not exit hole 224. Operation of the gate latch 200 is similar to the other embodiments described herein, with the fourth portion 240 inhibiting the bolt 202 from being completely being pulled out of the bracket 204.

While the eye lags, eye bolts, and U-bolts described herein, which are captured by bolts of the several embodiments of a gate latch, include circular portions, they can have other looped, non-circular shapes while still functioning adequately.

Advantages of a vertical bolt, double plate gate latch as described herein can include:

- Only one hand is needed to open latch and gate, and close gate and latch.
- When opening the latch, one's hand is already on the gate or door to open it.
- Latch falls to lock position when gate or door is closed.
- Wide opening between double plates permits latch to work if gate or post moves due to damage or weather changes.
- Latch is easily operated with heavy gloves or mittens on.
- Latch is easily operated by reaching through or over a gate when latch is on the other side.
- Quick and easy installation is possible on wood or metal surfaces.
- The latch is animal resistant.
- The latch is easily locked with a padlock.
- The latch is strong and secure (if an animal bends the gate, the latch will continue to hold the gate to the post).
- It is resistant to ice build-up (if ice does form on it, the ice can be easily broken off).
- A latch on the inside of a door can be operated from outside by a flexible cord extending through a hole in the door, above the latch, and tied to the top of the bolt.
- Multiple applications work well: Swing through gate; Swing to post gate; Outside or inside of in-opening door; Outside or inside of out-opening door; Flush or overlap door type; Sliding door to wall (inside or out); and Sliding door to sliding door (inside or out).

While the invention has been described in detail with reference to exemplary embodiments thereof, it will be apparent to one skilled in the art that various changes can be made, and equivalents employed, without departing from the scope of the invention. The foregoing description of the preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments as are suited to the particular use contemplated. It is intended that the scope of the invention be defined by the claims appended hereto, and their equivalents. The entirety of each of the aforementioned documents is incorporated by reference herein.

I claim:

1. A gate latch comprising:

a bracket including a vertical backplate, a lower plate, and an upper plate, each of the plates attached to and extending in the same direction away from the backplate, each of the plates including first and second throughholes, wherein the first throughhole of the lower plate is vertically aligned with the first throughhole of the upper plate, and the second throughhole of lower plate is vertically aligned with the second throughhole of the upper plate; and a rigid bolt including first, second, and third elongate portions, the first and third elongate portions being connected together, the second and third elongate portions being connected together, and the first and second elongate portions being parallel;

wherein the first elongate portion is movably positioned in the first throughholes of the upper and lower plates, and the second elongate portion is movably positioned in the second throughholes of the upper and lower plates;

wherein the second portion includes a free end opposite the third portion; and a recess formed in the second elongate portion on a side of the lower plate opposite the upper plate, the position of the recess and the length of the first portion being such that when the bolt is moved in the throughholes relative to the bracket, the first portion free end does not pass through the upper plate first throughhole when the recess is engaged with the lower plate.

2. A gate latch in accordance with claim 1, further comprising:

a loop positioned between the upper plate and the lower plate, the first portion extending through the loop.

3. A gate latch in accordance with claim 2, further comprising:

a securing device selected from the group consisting of an eye lag, and eye bolt, and a U-bolt, the securing device comprising said loop.

4. A gate latch in accordance with claim 1, wherein the first portion is shorter than the second portion.

5. A gate latch in accordance with claim 1, wherein the second portion includes a free end opposite the third portion, and further comprising:

a stop member extending through the second elongate portion on a side of the lower plate opposite the upper plate, the position of the stop member and the length of the first portion being such that when the bolt is moved in the first and second holes relative to the bracket, the first portion free end does not pass through the upper plate first throughhole.

6. A gate latch in accordance with claim 1, wherein each of the plates further comprises additional vertically aligned throughholes.

7. A gate latch in accordance with claim 1, further comprising:

an adapter plate mounted to the bracket, the adapter plate comprising a flange extending away from the bracket and a V-notch.

8. A gate latch in accordance with claim 7, further comprising a U-bolt mounted to the adapter plate, the U-bolt including a loop extending away from the bracket.

9. A gate latch in accordance with claim 1, further comprising:

an adapter plate comprising a flange extending away from the bracket and including a V-notch;

a first U-bolt attached to the adapter plate including a loop extending away from the bracket; and a second U-bolt attached to the adapter plate including a loop extending towards the bracket and between the upper and lower plates, the first portion extending through the second U-bolt loop and through throughholes of the upper and lower plates.

10. A gate latch in accordance with claim 1, wherein the second portion has a rectangular cross section.

* * * * *